United States Patent [19]

Bromley

[11] Patent Number: 5,038,954

[45] Date of Patent: Aug. 13, 1991

[54] SHIPPING AND STORING APPARATUS

[75] Inventor: Robert L. Bromley, Boulder, Colo.

[73] Assignee: Enseco Incorporated, Arvada, Colo.

[21] Appl. No.: 428,597

[22] Filed: Oct. 30, 1989

[51] Int. Cl.[5] ..... B65D 21/02

[52] U.S. Cl. ..... 220/23.4; 220/23.83; 220/4.27; 220/324; 220/315

[58] Field of Search ..... 220/23.4, 23.6, 315, 220/324, 326, 288, 4.26, 4.27, 23.2, 23.83, 524, 255; 206/503, 504, 508, 497

[56] References Cited

U.S. PATENT DOCUMENTS

| | | | |
|---|---|---|---|
| 2,470,057 | 5/1949 | Spender | 220/315 |
| 3,101,856 | 8/1963 | Whiteman | 220/288 |
| 3,103,278 | 9/1963 | Kuzma et al. | 220/23.6 |
| 3,393,824 | 7/1968 | Appleton | 220/288 |
| 3,425,586 | 2/1969 | Petters et al. | 220/23.4 |
| 3,455,480 | 7/1969 | Mitchell et al. | 220/23.4 |
| 3,892,326 | 7/1975 | Schneible | 220/315 |
| 3,986,634 | 10/1976 | Smith et al. | 220/288 |
| 4,212,318 | 7/1980 | Warmbold | 220/288 |
| 4,214,782 | 7/1980 | Boyer | 220/326 |
| 4,228,897 | 10/1980 | Underwood | 220/23.4 |
| 4,291,803 | 9/1981 | Perales | 220/23.83 |
| 4,509,639 | 4/1985 | Thompson | 220/23.4 |
| 4,535,906 | 8/1985 | Rowekamp | 220/288 |
| 4,708,256 | 11/1987 | Intardonato | 220/23.4 |
| 4,795,058 | 1/1989 | Hinds | 220/288 |
| 4,821,903 | 4/1989 | Hayes | 220/255 |
| 4,871,083 | 10/1989 | Dinardo | 220/23.4 |
| 4,909,434 | 3/1990 | Jones et al. | 220/288 |

*Primary Examiner*—Stephen Marcus
*Assistant Examiner*—S. Castellano
*Attorney, Agent, or Firm*—Dressler, Goldsmith, Shore, Sutker & Milnamow, Ltd.

[57] ABSTRACT

A shipping and storing container including a cubic-shaped shipping unit defining an open top cavity and a rotatable cover releasably secured thereto for closing the cavity. A peripheral side surface of the container defines two vertical channels which allow the container to be releasably coupled in a side-by-side relation to a like container by relative vertical movement between the containers. The configuration of the cover prevents it from rotating relative to the shipping unit when two containers are releasably secured together in side-by-side relation. A selectively operable security latch carried by the cover prevents inadvertent rotation of the cover relative to the shipping unit when the containers are separated. Each cover further includes an upstruck handle portion which facilitates handling of the containers and interlocks with a support base of a container stacked thereabove. A first seal is provided on the cover and shipping unit to prevent tampering with the articles carried within the container. A second seal is provided between joined containers to indicate whether the joined containers were separated during transport.

5 Claims, 4 Drawing Sheets

SHIPPING AND STORING APPARATUS

FIELD OF THE INVENTION

This invention relates to portable containers for shipping and storing articles therewithin and, more particularly, to a releasably closable and impact-resistant container which can be releasably coupled to a like container in a manner facilitating stacking of the containers one upon the other.

BACKGROUND OF THE INVENTION

Shipping containers come in a variety of different sizes and shapes. Some such containers include removable covers for protecting the articles stored within the container. The cover should be designed to assure securement to the container during transportation.

To facilitate transportation and handling of such containers, their size and weight should be such that they are readily portable from one location to another. Although transportation of such containers is an important consideration, the articles stored therewithin must be protected against damage during shipment. Thus, there is a delicate balance between making the containers portable while providing sufficient strength to protect the articles stored therewithin. Protection for articles stored within the containers is especially important when considering transportation of toxic materials from one location to another.

The ability to use shipping containers in integrated pairs further adds to their versatility. Moreover, it is desirable to provide containers which are reusable. That is, such containers should be constructed with sufficient durability to permit their use for more than a single shipment of goods or articles. Furthermore, having transported such containers to their ultimate destination, such containers should be stackable upon each other in a stable and secure manner.

SUMMARY OF THE INVENTION

In view of the above, and in accordance with the present invention, there is provided a reusable container for shipping and storing articles therewithin. Besides being both lightweight and strong, the container of the present invention is designed to be releasably coupled in a side-by-side relation to a like container. The paired containers facilitate stacking in a stable and secure manner.

While it can be desirable to use shipping containers in pairs, it should be appreciated that the shipping container of the present invention is usable either conjointly with a like container or independently of other like containers. Generally, each container of the present invention includes a box-like shipping unit, and a cover which is releasably securable to the shipping unit, with the assembled container being durable and readily handled. In a preferred form, the shipping unit and cover are formed from a foam-filled, high density polyethylene material.

In a presently preferred form, each shipping unit has a generally cubic shape or configuration with a lower support base and an opposite open top portion defining a cavity wherein articles are stored for protection against damage during transportation of the container. At least one peripheral side surface on the shipping unit is configured to define at least two vertical channels which facilitate the releasable coupling of two like shipping containers to each other as by relative vertical movement between the containers. Use of the present containers in assembled pairs facilitates stable stacking of the pairs in a criss-crossed, interlocking fashion.

The cover is adapted for releasable securement to the shipping unit in a manner closing the open top cavity. The cover is preferably generally square, and is releasably secured to the shipping unit in response to relative rotation between the shipping unit and the cover by the preferred provision of mating threads. In a preferred form of the invention, the shipping unit and cover are configured such that the cover is prevented from rotating relative to the shipping unit to which it is secured when two shipping containers are releasably coupled to each other.

To avoid inadvertent opening of the cover when the shipping containers are separated, each shipping container further includes a selectively operable security latch. In the preferred form, the security latch comprises an elongated, flexible bar or member which is secured to the cover of each shipping container. The latch defines a depending finger which is normally biased into interlocking engagement with a latch locking zone defined on the shipping unit in a manner preventing inadvertent rotation of the cover relative to the shipping unit. Moreover, the flexible latch normally extends above and across the releasable coupling established between a pair of releasably joined containers in a manner restricting relative vertical movement between two joined shipping containers.

In a preferred form of the invention, the top end of each shipping unit defines an internally threaded portion. The cover has a complementary externally threaded portion which engages the threads on the shipping unit when the cover is releasably secured to the shipping unit.

To further promote security, a tamperproof custody seal is provided between the cover and the shipping unit. In a preferred form, the shipping unit further defines a seal-receiving opening toward its upper end. Moreover, the security latch defines a passage which is preferably located proximate to the opening on the shipping unit when the cover is secured to the shipping unit. A shearable and flexible strip, passing through the passage formed by the security latch and the opening defined in the shipping unit, has its opposite ends secured together to form a closed loop. By such construction, the cover is prevented from rotating relative to the shipping unit without destroying the tamperproof seal.

To promote security between pairs of joined shipping containers, a security seal is provided. As will be appreciated from an understanding of the present invention, when a pair of shipping containers are releasably joined to each other, the security latch provided on one shipping container is arranged in confronting relation with the security latch provided on the other shipping container. In addition to the passage in the security latch for the tamperproof custody seal, the flexible latch further defines an aperture through which is passed a security seal in the form of a shearable and flexible strip. The opposite ends of the strip are secured together thereby assuring that the releasably joined pair of shipping containers are maintained in releasably joined association with each other as long as the security seal is not broken.

To facilitate transportation of the shipping containers either individually or as a pair, each cover includes an upstruck handle portion. Preferably, such a handle portion is formed as an integral part of the cover and extends across the cover. Moreover, the exterior surface of the lower support base of each shipping unit defines a series of elongated linear recesses. Each elongated recess is located on the support base to accommodate, in a releasable locking relationship, the upstruck handle portion of a shipping container which is stacked therebeneath. By establishing an interlocking relationship between stacked containers, stability is added when the containers are arranged in a stacked relationship. Moreover, providing a pair of containers in a releasably joined side-by-side relationship relative to each other further enhances stability when the containers are stacked one upon the other, particularly when two of the assembled container pairs are positioned in each tier of a stack, with the tiers oriented in alternating directions.

Numerous other features and advantages of the present invention will become readily apparent from the following detailed description, the accompanying drawings, and the appended claims.

DETAILED DESCRIPTION OF THE PREFERRED EMBODIMENT

Figure 2:
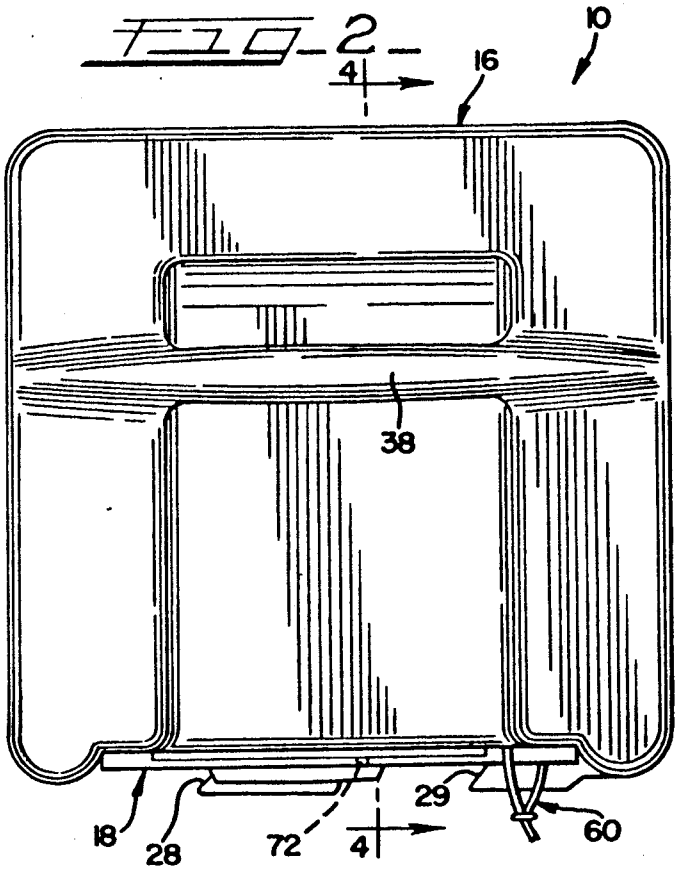
FIG. 2 is a top plan view of the present invention.

While the present invention is susceptible of embodiment in various forms, there is shown in the drawings and will hereinafter be described a presently preferred embodiment with the understanding that the present disclosure is to be considered as an exemplification of the invention, and is not intended to limit the invention to this specific embodiment illustrated.

Referring now to the drawings, wherein like reference numerals indicate like parts throughout the several views, there is shown a container 10 for shipping and storing articles therewithin. Preferably during use, two shipping containers are releasably joined together, in a manner described in detail hereinafter, to form a container assembly. The individual shipping containers are substantially identical to each other and therefore, they will be referred to as "like" containers. For purposes of simplicity and clarity, only one such shipping container will be described in detail.

Figure 1:
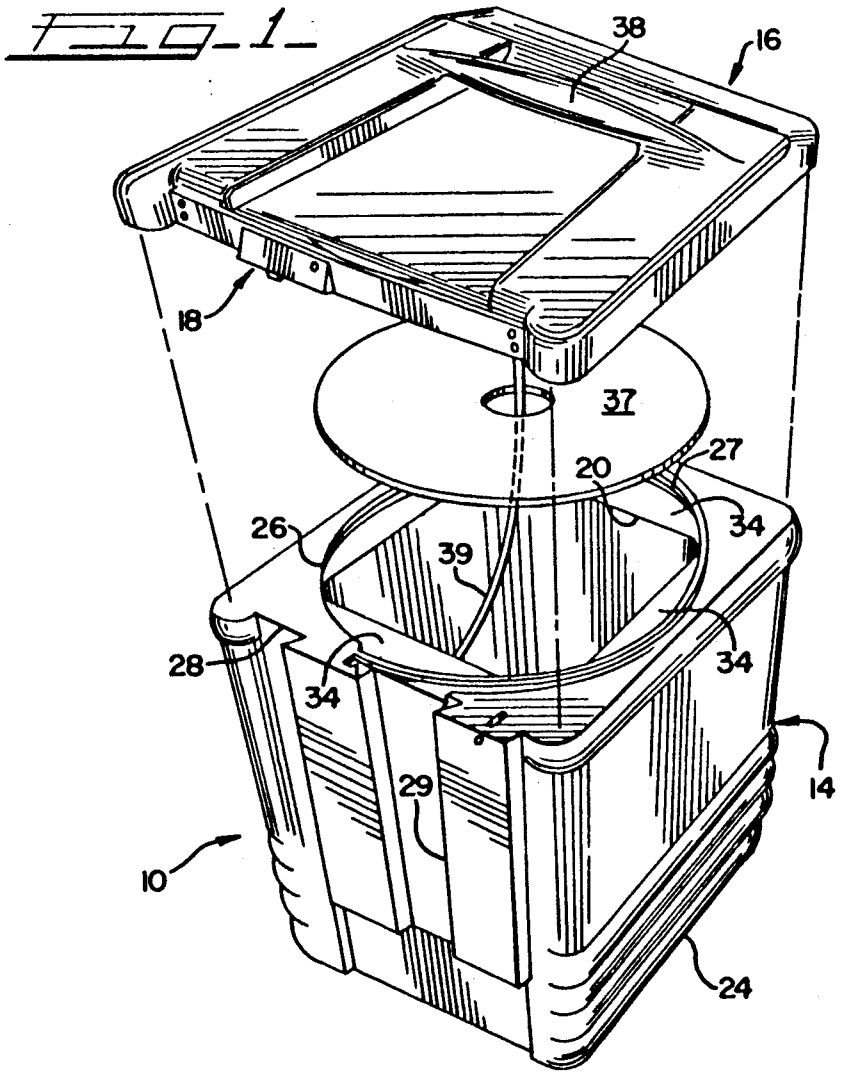
FIG. 1 is a perspective view of a storing and shipping container which embodies principles of the present invention.

As illustrated in FIG. 1, each shipping container 10 includes a shipping unit 14 and a cover 16 releasably securable thereto. Each container 10 further includes a security latch 18 for releasably locking cover 16 to the shipping unit 14 when the shipping containers are not joined together as a pair to form a container assembly.

Each shipping unit 14 is preferably formed in a molding process from a foam-filled, high density polyethylene material. The polyethylene structure yields a strong yet relatively lightweight shipping container which is capable of absorbing impacts without transferring impact loads to articles in the unit. Each shipping unit 14 defines an inner open top cavity 20 into which articles are stored for shipment. The space between the inner peripheral walls of cavity 20 and the outside walls of the shipping unit 14 is filled with expanded polystyrene foam or the like for shock-absorption and thermal insulation. The lower end of shipping unit 14 defines a support base 24 while the top end of the shipping unit defines a sxirt portion 26 which extends upwardly from the top edge of cavity 20 and is preferably formed integrally with the shipping unit. Skirt portion 26 includes oversized internal threading 27.

Figure 4:
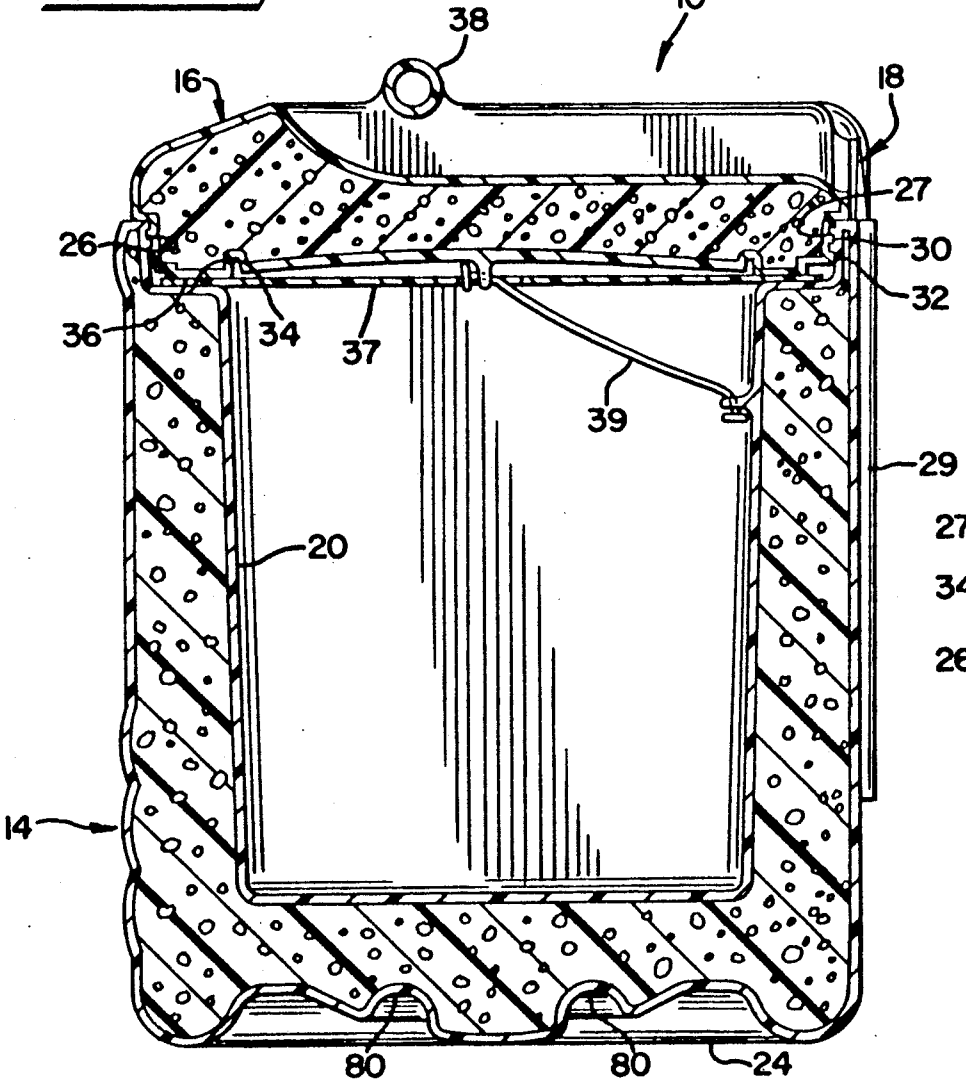
FIG. 4 is a sectional view taken along line 4—4 of FIG. 2.

Particularly as illustrated, each shipping unit 14 has a generally cubic shape. At least one side peripheral surface on each shipping unit preferably defines at least two spaced apart vertical channels 28 and 29. As illustrated in FIGS. 1 and 4, channels 28 and 29 do not necessarily extend the full length of the vertical surface the shipping unit. For purposes of strength, such channels are preferably formed as an integral part of the shipping unit.

As illustrated in FIGS. 1, 2, 3, and 5, each channel 28, 29 has a generally dovetail cross sectional configuration. By such construction channels, 28, 29 on one shipping contained coact with like channels on a like shipping container, by relative vertical movement between the contain in a manner releasably the shipping container to each Turning to FIG. 4, cover 16 is preferably formed from a foam-filled, high density polyethylene material and has a generally square planar configuration which complements the configuration of shipping unit 14. On its underside, cover 16 is provided with a depending threaded portion 30 having oversized external threading 32 which coacts with the threaded skirt portion 26 on shipping unit 14. In the preferred embodiment, nearly one turn of cover 16 secures the cover 16 to shipping unit 14.

Figure 3:
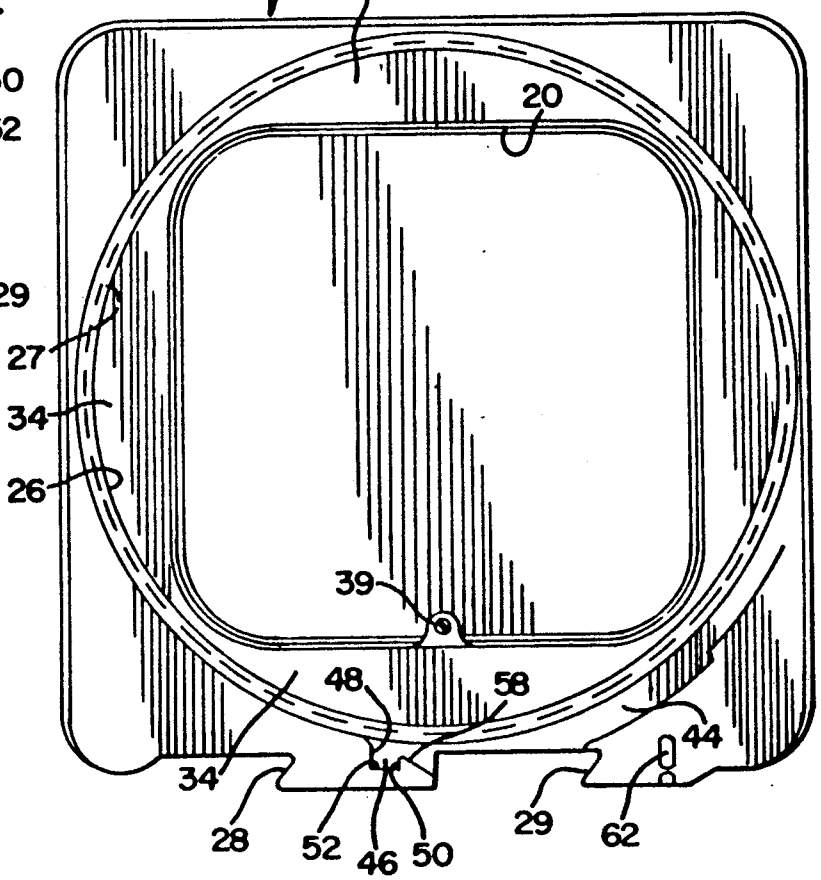
FIG. 3 is a top plan view similar to FIG. 2 but having a cover removed therefrom.

As illustrated in FIGS. 1, 3 and 4, circularly threaded portion 26 of shipping unit 14 is larger than the cavity 20 to provide an annular surface 34 toward the upper end of the shipping unit 14. The underside of the depending threaded portion 30 on cover 16 defines a generally annular surface 36. A disc-like sealing element 37; preferably made of a suitable leakproof material is arranged between surface 34 on unit 14 and surface 36 on cover 16 when cover 16 is secured to unit 14. As cover 16 is secured to shipping unit 14, the annular sealing element 37 is compressed between surfaces 34 and 36 to establish a tight, substantially leakproof seal between unit 14 and cover 16.

On its top side, cover 16 is provided with a handle portion 38 which facilitates handling of the container 10. Handle portion 38 is preferably offset from the center of cover 16 and extends upwardly from cover 16 substantially across its width. For purposes of strength and simplicity of manufacture, handle portion 38 is formed as a integral part of cover 16.

To reduce the chances of cover 16 becoming lost or disassociated from its respective shipping unit 14, a tie 39 is provided to interconnect the cover 16 with its respective shipping unit 14. In a preferred form, tie 39 includes an elongated, flexible strip-like material which passes through sealing element 37 and has one end releasably secured to cover 14 at a generally central location on surface 36 to not interfere with rotation of cover 16. The other end of tie 39 is releasably secured within cavity 20 of the shipping unit preferably on the adjacent inside wall of the vertical channels 28, 29. The length of tie 39 is such that cover 16, when not threadably fastened to unit 14, will rest along the outside of the shipping unit 14 in a position above the support base 24 to avoid having the cover 16 touching the ground or being placed on dirt or mud during loading of the container 10.

Figure 9:
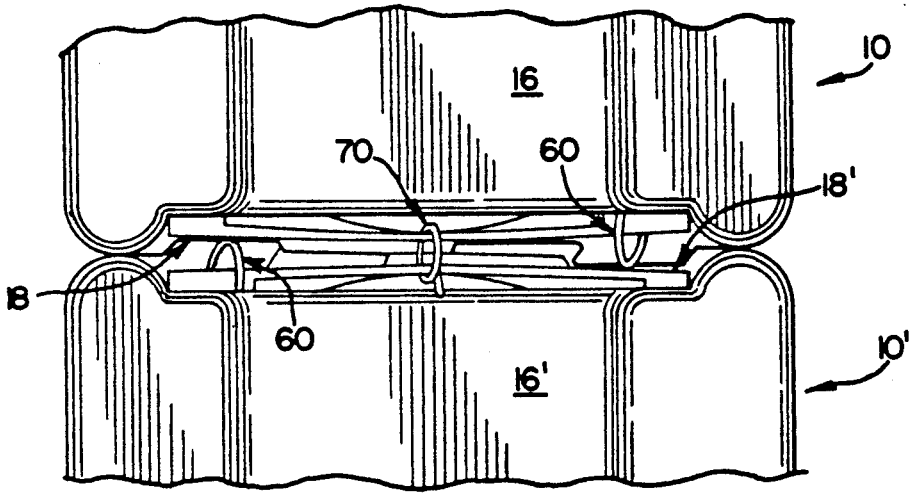
FIG. 9 is a fragmentary plan view of two shipping containers according to the present invention arranged in a releasable locking relationship relative to each other.

As viewed in FIG. 9, when two like shipping containers 10 and 10' are releasably secured together to form a container assembly, the cover 16 on either of the containers is normally prevented from rotating relative to the shipping unit to which is secured by virtue of the size and configuration of the cover, which results in interfering surfaces with the cover on the adjacent shipping container if rotation is attempted. The security latch 18 is provided on each cover to promote security between the cover 16 to which it is secured and the shipping unit 14 to which it is not secured when the container assembly is separated into individual shipping containers.

Figure 6:
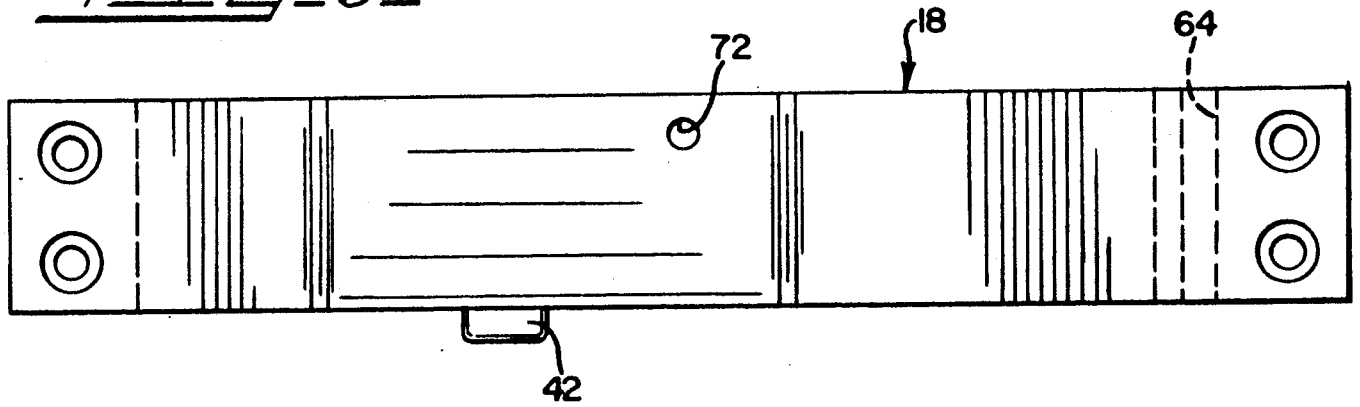
FIG. 6 is an elevational view of a security latch which is secured to a cover of the present invention.
Figure 7:
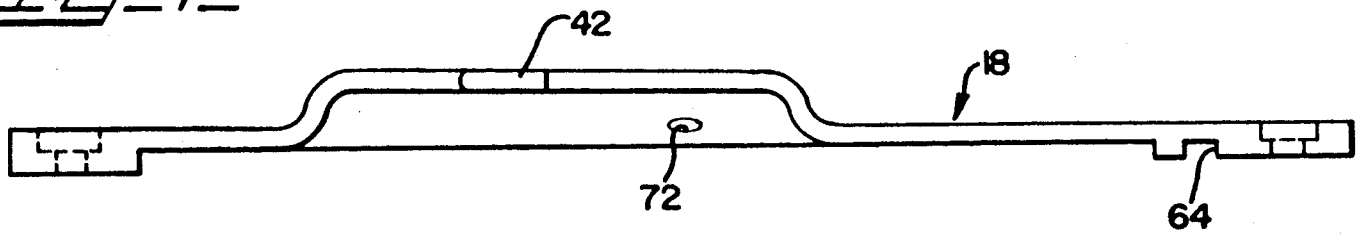
FIG. 7 is a bottom view of the security latch of FIG. 6.
Figure 8:
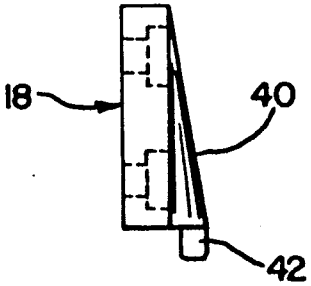
FIG. 8 is a side elevational view of the security latch illustrated in FIG. 6.

Particularly as illustrated in FIGS. 6, 7 and 8, the security latch 18 comprises an apertured and elongated flexible member. Preferably, latch 18 is formed from a material which has a natural spring bias. Intermediate its ends, and preferably formed to one side of its longitudinal center, latch 18 is provided with a short depending knob or finger 42. The security latch 18 is suitably secured to cover 16 in a non-removable fashion as by tamperproof fasteners.

Figure 5:
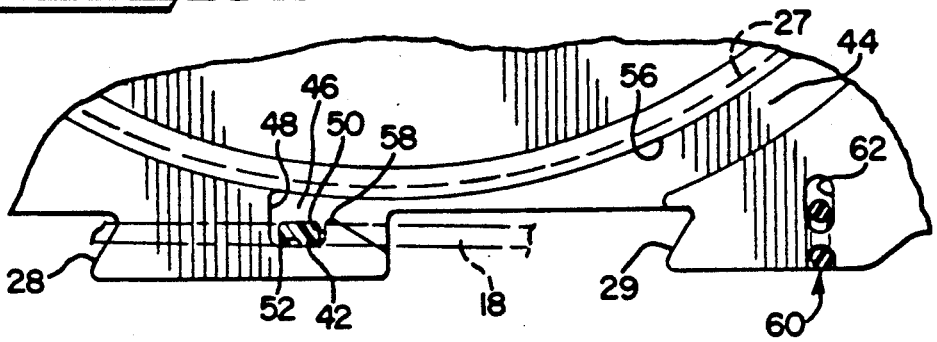
FIG. 5 is an enlarged top plan view of a peripheral edge portion of a container.

As best viewed in FIGS. 3 and 5, each shipping unit 14 further defines, at the top surface thereof, a generally arcuate locking channel 44 which is concentric with the internal threads 27 on the unit. The locking channel 44 terminates at one end in a latch locking zone 46. Latch locking zone 46 is defined by a recessed area bounded by a pair of laterally spaced, upstruck side walls 48, 50 which are joined by an upstruck forward wall 52. As best illustrated in FIG. 5, wall 48 extends inwardly from forward wall 52 and is joined to an inner radial wall 56 defined by channel 44. Wall 50 extends inwardly from forward wall 52 and terminates inwardly short of the radial inner wall 56. The terminal end of wall 50 defines a lock 58 having an inclined camming surface which lies in the path of the locking finger 42 when cover 16 is being secured to container unit 14.

As illustrated in FIGS. 2 and 5, a tamperproof custody seal 60 may also be provided for the individual shipping containers. The purpose of tamperproof custody seal 60 is to provide means for detecting whether cover 16 has been removed from shipping unit 14 in an unauthorized manner.

In a preferred embodiment, and as illustrated in FIG. 5, each shipping unit 14 defines a seal-receiving opening 62 provided at the top or upper end of the unit at the peripheral side surface on the shipping unit onto which latch 18 is secured. Turning to FIGS. 6 and 7, each latch 18 further defines a vertically extending groove 64 which, when latch 18 is secured to its respective cover 16, is in substantial alignment with opening 62 in shipping unit 14. Tamperproof custody seal 60 is made of a flexible and shearable material which passes through groove 64 between latch 18 and shipping unit 14 and through opening 62 in shipping unit 14. The free ends of the seal 60 are secured together to form a closed loop which prevents cover 16 from being rotated relative to container 14 without destroying the seal 60.

As illustrated in FIG. 9, a security seal 70 may also be provided when two shipping containers 10 and 10' are shipped attached to each other. The purpose of security seal 70 is to provide a means for detecting whether the two shipping containers were separated during shipping.

Turning to FIG. 9, when two shipping containers 10 and 10' are releasably coupled together, the security latches 18 and 18' of the respective containers are arranged in confronting relation. In a preferred form, each security latch 18 defines an aperture 72 which is located proximate to the longitudinal center of latch 18 and which generally aligns with a like aperture on opposing latch 18' of unit 10'. Security seal 70 is made of a shearable and flexible material which is passed through the aperture 72 in each latch. The free ends of the security seal 70 are secured together to form a closed loop. As such, the security latches 18 and 18' are secured to each other. Absent such a security seal, it would be readily possible to separate the two containers from each other without indication of such separation.

As will be readily appreciated, the releasable coupling of two containers 10 and 10' to each other adds stability when such container assemblies are stacked upon each other. To further promote stability when such shipping packages are stacked upon each other, the support base 24 of each container unit 14 is designed to coact with the upstruck handle portion 38 of the cover 16 therebeneath in a manner adding stability to the stacked containers.

Figure 10:
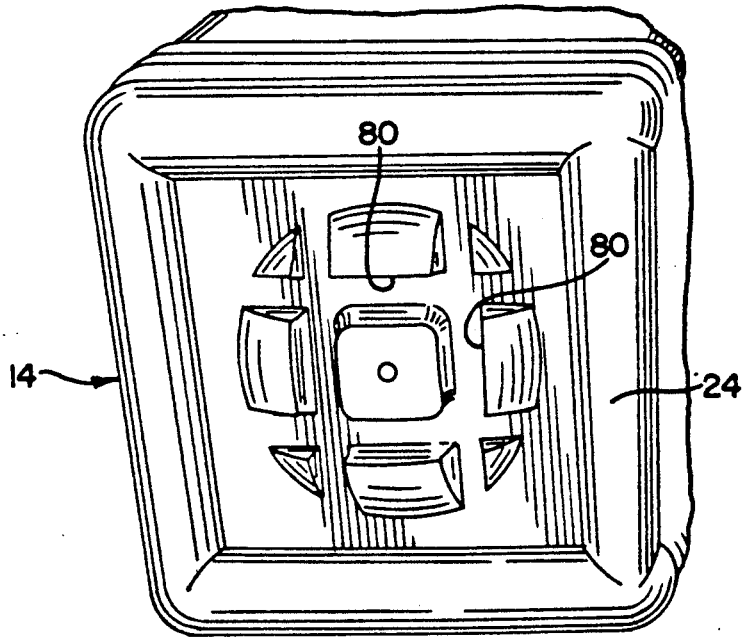
FIG. 10 is a perspective view of a shipping container's support base.

Turning to FIGS. 4 and 10, the support base 24 of each container unit 14 is provided with a series of generally straight line and intersecting recesses or grooves 80. Such recesses or grooves 80 cooperate with the upstruck handle portion 38 of a shipping container cover 16 disposed therebeneath in an interlocking relationship during storage to provide stability to the stacked container assemblies. As will be appreciated, the provision of four of the grooves 80 in the illustrated arrangement permits the handle portion 38 of another container to be in one of the grooves irrespective of the relative right-angle orientation of the containers.

During use, articles to be transported are placed within the cavity 20 of the container 10 and the cover 16 is secured to the shipping unit 14 by relative rotation. Once cover 16 is secured to its respective shipping unit 14, the sealing element 37, captively received between annular surface 34 on shipping unit 14 and surface 36 on cover 16, establishes a substantially leakproof seal. In the preferred form, nearly one turn of the cover 16 secures the cover to the shipping container 14.

As cover 16 is rotated relative to the shipping unit 14, the depending finger 42 on the security latch 18 is moved through the arcuate locking channel 44. Locking finger 42 engages the camming surface of the lock 58, with the resiliency of latch 18 allowing sufficient flexure of the latch to allow passage of the finger 42 past the lock 58. Having passed the lock 58, however, the resiliency of flexible latch 18 urges finger 42 into the latch locking zone 46 and against the forward wall 52 thereof in a manner retaining cover 16 against further rotation by the coaction of the finger 42 with the side walls 48, 50 of latch locking zone 46. As such, the security latch 18 prevents inadvertent rotation of the cover 16 with respect to the container unit 14.

For purposes of security, one end of the tamperproof custody seal 60 may now be passed through groove 64 behind the latch 18 and through opening 62 in the container unit 14. The free ends of the seal 60 are thereafter joined together forming a closed loop. As such, cover 16 cannot be rotated with respect to the container unit 14 without destroying the seal 60. The uniqueness of the present invention allows the combination of the cover 16 and container unit 14 to be shipped as a single assembly.

To promote stability during stacking, however, it may be desirable to join two of the shipping containers together by a releasable connection to form a shipping assembly. To effect these ends, one container is positioned generally above and to one side of the other container. The security latch 18 of the lower one of the containers is temporarily flexed to an out-of-the-way position by interference between the shipping units, and the vertical channels 28', 29' of one shipping container are moved in a relative vertical manner with respect to the vertical channels 28, 29 of the other unit whereby shipping container 10 is releasably coupled to shipping container 10'. Each latch 18 is preferably configured to define a camming surface 40 at the region of finger 42. The camming surface 40 is engaged by a lower end portion of the coupling channels of the upper container during initial vertical movement for coupling to the upper end portion of the vertical channels 28 and 29 of the lower shipping unit 14 thereby automatically achieving the temporary flexing of the latch 18 of the lower container.

Turning to FIG. 9, when the units are joined together, the security latch 18 on one shipping container extends above and across the releasable coupling between containers 10 and 10' in a manner preventing vertical displacement of the containers 10 and 10' with respect to each other. When two shipping containers units are joined in the manner illustrated, the security latches 18 of the shipping containers are arranged in confronting relation. With the security latches being in confronting relation, security seal 70 is used to join the security latches together as by passing the seal through the apertures 72 in the latches and securing together the ends of the seal in a manner preventing vertical displacement of the units with respect to each other without destroying the seal 70.

Besides increasing transportation capacity, joining the two shipping containers together as a container assembly further promotes stability when the container assemblies are stacked upon each other. The upstruck handle portion 38 of each cover 16 interlocks with the grooves 80 defined by the support base 24 of a shipping assembly stacked thereabove to add stability to the stack. Notably, the offset arrangement of handle portion 38 allows the shipping container to be carried in a manner improving weight distribution and reducing back and arm strain by aligning the handle portions 38 with the width of average shoulders.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A shipping and storing apparatus comprising:

a pair of closable containers which are releasably coupled to each other by relative vertical sliding movement between said containers, each container comprising a shipping unit defining an open top cavity and cover means secured to and associated with said unit by relative rotational movement therebetween for closing said cavity in said shipping unit, wherein said shipping unit has a generally cubic configuration with a peripheral side surface defining at least two laterally spaced channels which coact with like channels on the other container to releasably couple the containers to each other, and wherein the cover means of each container has a generally square configuration which prevents the cover means from rotating relative to the associated shipping unit to which it is secured when the containers are releasably coupled to each other.

2. The shipping and storing apparatus of claim 1 wherein each container further includes latching means carried by said cover means for releasably securing said cover means to said shipping unit independently of said containers being coupled to each other.

3. The shipping the storing apparatus of claim 2 wherein the latching means on the cover means are in confronting relation with each other when the containers are releasably coupled to each other.

4. The shipping and storing apparatus of claim 2 wherein each said latching means is an elongated and aperture flexible member which normally extends above and across the vertical channels of said shipping unit in a manner restricting relative vertical movement between said containers.

5. The shipping and storing apparatus of claim 4 further including seal means passing through both apertured flexible members of said shipping apparatus for sealing said containers to each other.

* * * * *